US005774847A

United States Patent [19]

Chu et al.

[11] Patent Number: 5,774,847

[45] Date of Patent: Jun. 30, 1998

[54] METHODS AND APPARATUS FOR DISTINGUISHING STATIONARY SIGNALS FROM NON-STATIONARY SIGNALS

[75] Inventors: Chung Cheung Chu, Brossard; Rafi Rabipour, Cote St. Luc, both of Canada

[73] Assignee: Northern Telecom Limited, Montreal, Canada

[21] Appl. No.: 933,531

[22] Filed: Sep. 18, 1997

Related U.S. Application Data

[63] Continuation of Ser. No. 431,224, Apr. 29, 1995, abandoned.

[51] Int. Cl.[6] ..... G10L 9/14

[52] U.S. Cl. ..... 704/237; 704/219; 704/233; 704/239

[58] Field of Search ..... 704/219, 233, 704/237, 239

[56] References Cited

U.S. PATENT DOCUMENTS

| | | | |
|---|---|---|---|
| 4,185,168 | 1/1980 | Graupe et al. | 381/68 |
| 4,357,491 | 11/1982 | Daaboul | 179/1 |
| 4,357,494 | 11/1982 | Daaboul | 704/233 |
| 4,401,849 | 8/1983 | Ichikawa et al. | 704/210 |
| 4,410,763 | 10/1983 | Strawczynski et al. | 704/214 |
| 4,426,730 | 1/1984 | Lajotte et al. | 704/233 |
| 4,672,669 | 6/1987 | DesBlache et al. | 704/237 |
| 4,918,733 | 4/1990 | Daugherty | 704/241 |
| 5,027,404 | 6/1991 | Taguchi | 704/221 |
| 5,293,588 | 3/1994 | Satoh et al. | 704/233 |
| 5,323,337 | 6/1994 | Wilson et al. | 364/574 |
| 5,390,280 | 2/1995 | Kato et al. | 704/233 |
| 5,459,814 | 10/1995 | Gupta et al. | 704/233 |
| 5,579,435 | 11/1996 | Jansson | 704/233 |

FOREIGN PATENT DOCUMENTS

| | | | |
|---|---|---|---|
| 0 335 521 | 3/1989 | European Pat. Off. | G10L 3/00 |
| 0 392 412 | 4/1990 | European Pat. Off. | G10L 3/00 |
| 0 538 536 A1 | 10/1991 | European Pat. Off. | H04J 3/17 |
| 0 571 079 A1 | 4/1993 | European Pat. Off. | H03G 3/34 |
| WO93/13516 | 7/1993 | WIPO | G10L 3/00 |
| WO 94/28542 | 5/1994 | WIPO . | |
| WO 95/12879 | 5/1994 | WIPO . | |

OTHER PUBLICATIONS

"The Voice Activity Detector for the Pan–European Digital Cellular Mobile Telephone Service", Freeman, D.K., et al, IEEE International Conference on Acoustic Speech and Signal Processing, 1989, vol. 1, pp. 369–372.

"The Voice Activity Detector for the Pan–European Digital Cellular Mobile Telephone Service", Freeman, D.K., et al, IEEE International Conference on Acoustic Speech and Signal Processing, 1989, vol. 1, pp. 369–372.

*Primary Examiner*—David R. Hudspeth
*Assistant Examiner*—Tálivaldis Ivars Šmits
*Attorney, Agent, or Firm*—C. W. Junkin

[57] ABSTRACT

In methods and apparatus for distinguishing stationary signals from non-stationary signals, a set of Linear Predictive Coding (LPC) coefficients characterizing spectral properties of the signal for each of a plurality of successive time intervals, including a current time interval, is determined. The LPC coefficients are averaged over a plurality of successive time intervals preceding the current time interval, and a cross-correlation of the LPC coefficients for the current time interval with the averaged LPC coefficients is determined. The signal is declared to be stationary in the current time interval when the cross-correlation exceeds a threshold value, and is declared to be non-stationary in the current time interval when the cross-correlation is less than the threshold value. The methods and apparatus are particularly applicable to detection of transitions between an absence of speech state, characterized by a stationary signal, and a presence-of-speech state characterized by a non-stationary signal.

23 Claims, 9 Drawing Sheets

METHODS AND APPARATUS FOR DISTINGUISHING STATIONARY SIGNALS FROM NON-STATIONARY SIGNALS

This application is a continuation of application Ser. No. 08/431,224, filed on Apr. 28, 1995 abandoned.

FIELD OF INVENTION

This invention relates to methods and apparatus for distinguishing speech intervals from noise intervals in audio signals.

DEFINITION

In this specification the term "noise interval" is meant to refer to any interval in an audio signal containing only sounds which can be distinguished from speech sounds on the basis of measurable characteristics. Noise intervals may include any non-speech sounds such as environmental or background noise. For example, wind noise and engine noise are environmental noises commonly encountered in wireless telephony.

BACKGROUND OF INVENTION

Audio signals encountered in telephony generally comprise speech intervals in which speech information is conveyed interleaved with noise intervals in which no speech information is conveyed. Separation of the speech intervals from the noise intervals permits application of various speech processing techniques to only the speech intervals for more efficient and effective operation of the speech processing techniques. In automated speech recognition, for example, application of speech recognition algorithms to only the speech intervals increases both the efficiency and the accuracy of the speech recognition process. Separation of speech intervals from noise intervals can also permit compressed coding of the audio signals. Moreover, separation of speech intervals from noise intervals forms the basis of statistical multiplexing of audio signals.

U.S. Pat. No. 5,579,435, entitled "Discriminating Between Stationary and Non-Stationary Signals", was issued in the name of Klas Jansson on Nov. 26, 1996. This patent discloses a method and apparatus for distinguishing stationary signals from non-stationary signals. The method comprises performing a long-term LPC analysis for each of plurality of successive time intervals of an audio signal to derive long-term LPC coefficients, synthesizing an inverse filter characteristic from the long-term LPC coefficients for each successive interval, applying the inverse filter characteristic to the an excitation for each successive time interval, computing a residual energy for each successive time interval, and detecting changes in the residual energy over successive time intervals to determine whether the signal is stationary or non-stationary. This procedure is computationally expensive because the calculation of the long-term LPC coefficients, the synthesis of the inverse filter characteristic and the application of the inverse filter characteristic to an excitation are computationally intensive steps performed for each successive time interval. Moreover, Jansson fails to teach that distinguishing stationary intervals from non-stationary intervals can be used to detect transitions from absence-of-speech states to presence-of-speech states.

SUMMARY OF INVENTION

An object of this invention is to provide novel and computationally relatively simple methods and apparatus for distinguishing a stationary signal from a non-stationary signal. Such methods and apparatus may be useful for distinguishing detecting transitions between an absence-of-speech state and a presence-of-speech state in an audio signal.

One aspect of the invention provides a method of distinguishing a stationary signal from a non-stationary signal. The method comprises determining a set of Linear Predictive Coding (LPC) coefficients characterizing spectral properties of the signal for each of a plurality of successive time intervals including a current time interval; averaging the LPC coefficients over a plurality of successive time intervals preceding the current time interval; determining a cross-correlation of the LPC coefficients for the current time interval with the averaged LPC coefficients; declaring the signal to be stationary in the current time interval when the cross-correlation exceeds a threshold value; and declaring the signal to be non-stationary in the current time interval when the cross-correlation is less than the threshold value.

The step of determining a set of LPC coefficients for each of the plurality of successive time intervals may comprise defining a respective vector of LPC coefficients for each time interval. The step of averaging the LPC coefficients may comprise defining a time averaged vector of LPC coefficients. The step of determining a cross-correlation may comprise calculating an inner product of the vector of LPC coefficients for the current time interval and the time averaged vector of LPC coefficients.

The step of determining a cross-correlation may comprise dividing the inner product by a product of a magnitude of the vector of LPC coefficients for the current time frame and a magnitude of the time averaged vector of LPC coefficients.

The threshold value may be adjusted in response to a distribution of cross-correlations calculated for preceding time intervals.

The LPC coefficients may comprise a set of LPC reflection coefficients.

Another aspect of the invention provides apparatus for distinguishing a stationary signal from a non-stationary signal. The apparatus comprises a processor and a memory connected to the processor storing instructions for execution by the processor. The instructions comprise instructions for determining a set of Linear Predictive Coding (LPC) coefficients characterizing spectral properties of the signal for each of a plurality of successive time intervals including a current time interval; instructions for averaging the LPC coefficients over a plurality of successive time intervals preceding the current time interval; instructions for determining a cross-correlation of the LPC coefficients for the current time interval with the averaged LPC coefficients; instructions for declaring the signal to be stationary in the current time interval when the cross-correlation exceeds a threshold value; and instructions for declaring the signal to be non-stationary in the current time interval when the cross-correlation is less than the threshold value.

Yet another aspect of the invention provides a processor-readable storage device storing instructions for distinguishing a stationary signal from a non-stationary signal. The instructions comprise instructions for determining a set of Linear Predictive Coding (LPC) coefficients characterizing spectral properties of the signal for each of a plurality of successive time intervals including a current time interval; instructions for averaging the LPC coefficients over a plurality of successive time intervals preceding the current time interval; instructions for determining a cross-correlation of the LPC coefficients for the current time interval with the averaged LPC coefficients; instructions for declaring the signal to be stationary in the current time interval when the cross-correlation exceeds a threshold value; and instructions for declaring the signal to be non-stationary in the current time interval when the cross-correlation is less than the threshold value.

A further aspect of the invention provides a method of detecting transitions between an absence-of-speech state and a presence-of-speech state in an audio signal. The method comprises, in the absence-of-speech state detecting a transition to the presence-of-speech state by determining a set of Linear Predictive Coding (LPC) coefficients characterizing spectral properties of the signal for each of a plurality of successive time intervals including a current time interval; averaging the LPC coefficients over a plurality of successive time intervals preceding the current time interval; determining a cross-correlation of the LPC coefficients for the current time interval with the averaged LPC coefficients; and declaring a transition to the presence-of-speech state when the cross-correlation is less than a threshold value.

The methods and apparatus of the invention are computationally simpler than known methods and apparatus for distinguishing stationary signals from non-stationary signals and known methods and apparatus for detecting transitions between an absence-of-speech state and a presence-of-speech state in an audio signal.

While declaring noise intervals, the first parameter set may characterize spectral properties of the audio signal, and the second parameter set may characterize a magnitude of change in the spectral properties of the audio signal. For example, the first parameter set may comprise Linear Predictive Coding (LPC) reflection coefficients and the second set of parameters may indicate a magnitude of change of relative values of the LPC coefficients over a plurality of preceding time intervals.

The LPC reflection coefficients may be averaged over a plurality of successive time intervals to calculate time averaged reflection coefficients. The second parameter set may be determined by defining a first vector of the reflection coefficients calculated for a particular time interval, defining a second vector of the time averaged reflection coefficients calculated for a plurality of successive time intervals preceding the particular time interval, and calculating a normalized correlation defined as an inner product of the first vector and the second vector divided by a product of the magnitudes of the first and second vectors. The normalized correlation may be compared to a threshold value to determine whether the second parameter set indicates a magnitude of change greater than the predetermined change.

The comparison may be in two steps. In a first comparison, the normalized correlation may be compared to a first threshold value to determine whether the second parameter set indicates a magnitude of change greater than the predetermined change. When the first comparison does not indicate a magnitude of change greater than the predetermined change, the normalized correlation may be compared to a second threshold value to determine whether the second parameter set indicates a magnitude of change greater than the predetermined change. The second threshold value may be adjusted in response to a distribution of normalized correlations calculated for preceding time intervals.

Alternatively or in addition, the first parameter set may comprise an energy level of the audio signal. While declaring speech intervals, for example, the first parameter set may include a weighted average of energy parameters calculated for a plurality of successive time intervals. In this case, the step of determining a second parameter set may comprise comparing the weighted average of energy parameters to weighted averages calculated for each of a plurality of preceding time intervals to calculate a plurality of energy differences, and incrementing a flat energy counter when all of the calculated energy differences are less than a difference threshold. The second parameter set is deemed to indicate a magnitude of change less than the predetermined change when the flat energy counter exceeds a flat energy threshold.

Another aspect of this invention provides apparatus for distinguishing speech intervals from noise intervals in a audio signal. The apparatus comprises a processor, a memory containing instructions for operation of the processor, and an input arrangement for coupling the audio signal to the processor. The processor is operable according to the instructions to determine a first parameter set characterizing the audio signal for each of a plurality of successive time intervals, to determine a second parameter set for each of the time intervals, the second parameter set being indicative of a magnitude of change in the first parameter set over a plurality of preceding time intervals, to declare the time intervals to be speech intervals when the second parameter set indicates a magnitude of change greater than a predetermined change, and to declare the time intervals to be noise intervals when the second parameter set indicates a magnitude of change less than the predetermined change.

BRIEF DESCRIPTION OF DRAWINGS

Embodiments of the invention are described below by way of example only. Reference is made to accompanying drawings in which.

DETAILED DESCRIPTION

Figure 1:
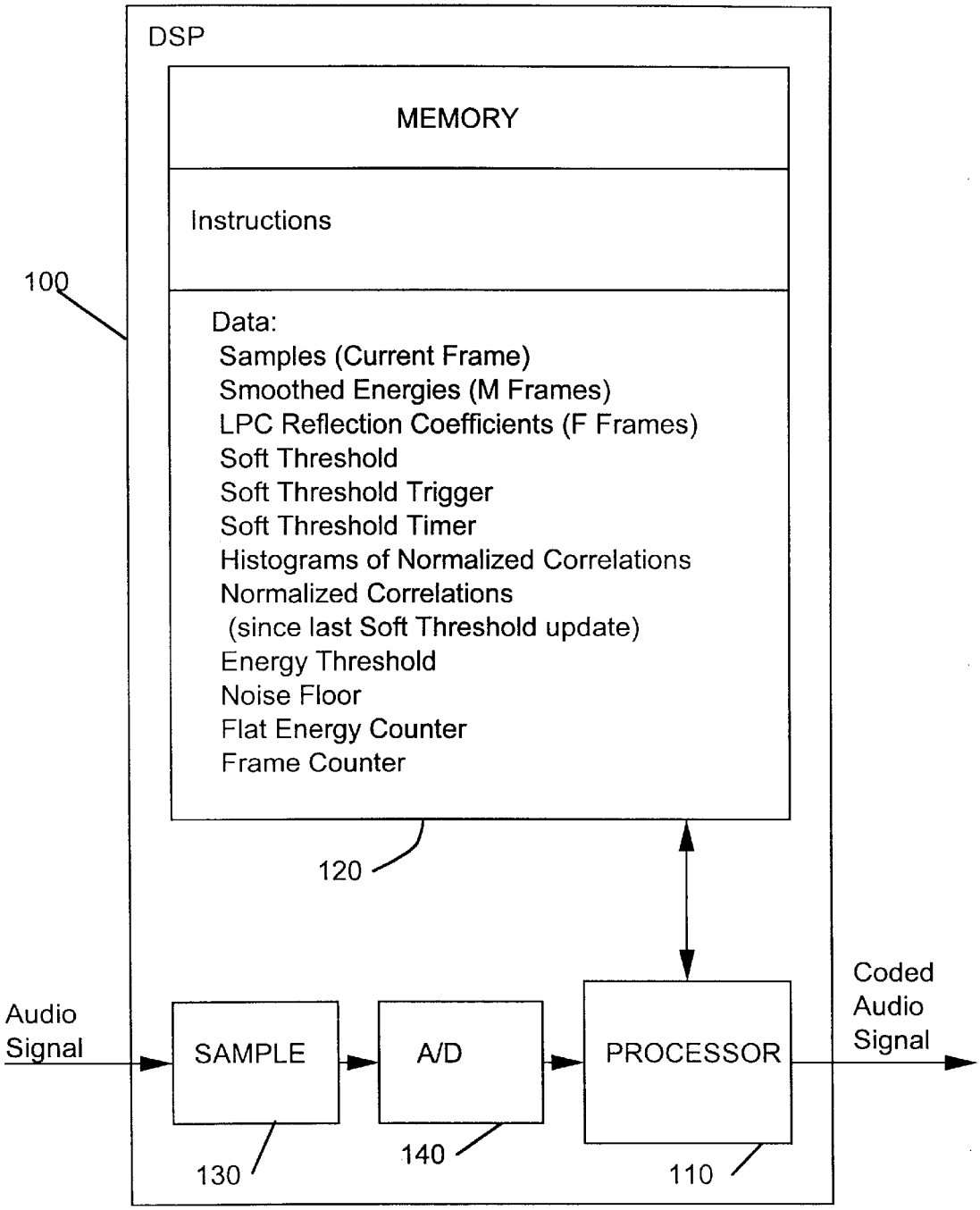
FIG. 1 is a block schematic diagram of a Digital Signal Processor (DSP) according to an embodiment of the invention.

FIG. 1 is a block schematic diagram of a Digital Signal Processor (DSP) 100 according to an embodiment of the invention. The DSP 100 comprises a processor 110, a memory 120, a sampler 130 and an analog-to-digital converter 140. The sampler 130 samples an analog audio signal at 0.125 ms intervals, and the analog-to-digital converter 140 converts each sample into a 16 bit code, so that the analog-to-digital converter 140 couples a 128 kbps pulse code modulated digital audio signal to the processor 110. The processor 110 operates according to instructions stored in the memory 120 to apply speech processing techniques to the pulse code modulated signal to derive a coded audio signal at a bit rate lower than 128 kbps.

Figure 2:
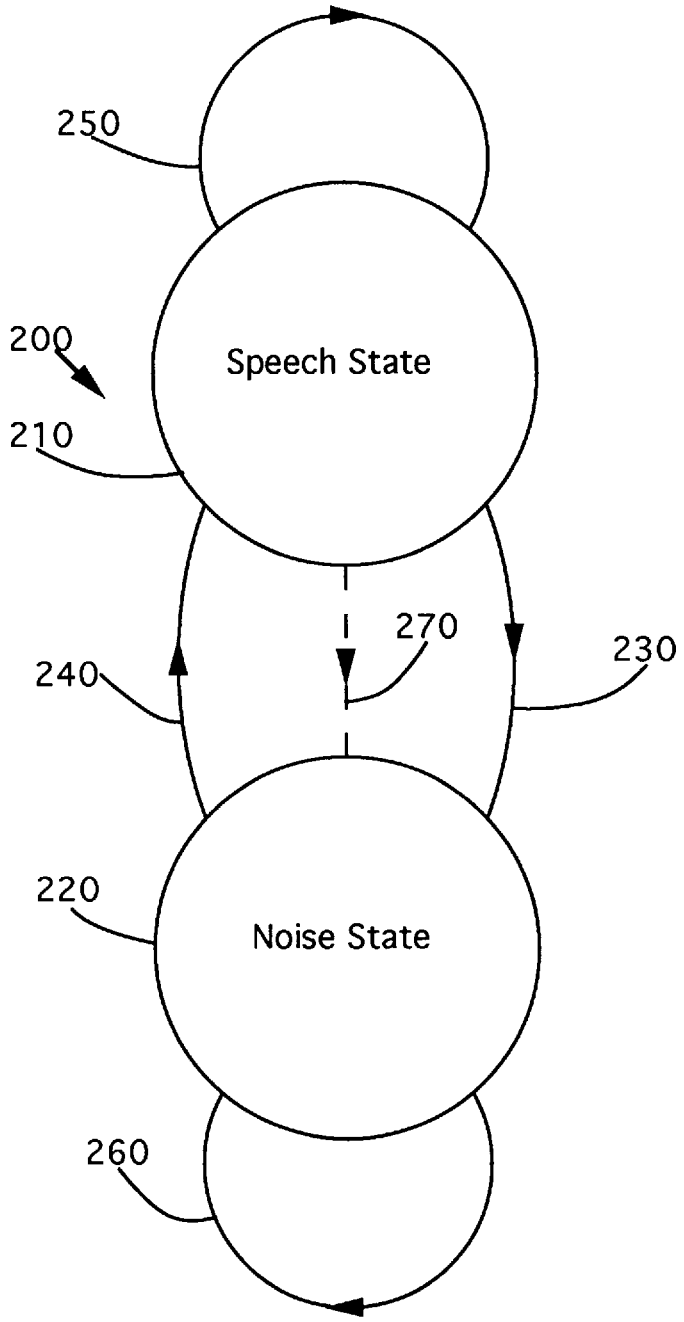
FIG. 2 is a schematic diagram of state machine by which the DSP of FIG. 1 may be modelled in respect of certain operations performed by the DSP.

As part of the speech processing applied to the input audio signal, the DSP 100 distinguishes speech intervals in the input audio signal from noise intervals in the input audio signal. For this part of the speech processing, the DSP 100 can be modelled as a state machine 200 as illustrated in FIG. 2. The state machine 200 has a speech state 210, a noise state 220, a speech state to noise state transition 230, a noise state to speech state transition 240, a speech state to speech state transition 250 and a noise state to noise state transition 260 and a fast speech state to noise state transition 270. The DSP 100 divides the 128 kbps digital audio signal into 20 ms frames (each frame containing 160 16 bit samples) and, for each frame, declares the audio signal to be in either the speech state 210 or the noise state 220.

Figure 3:
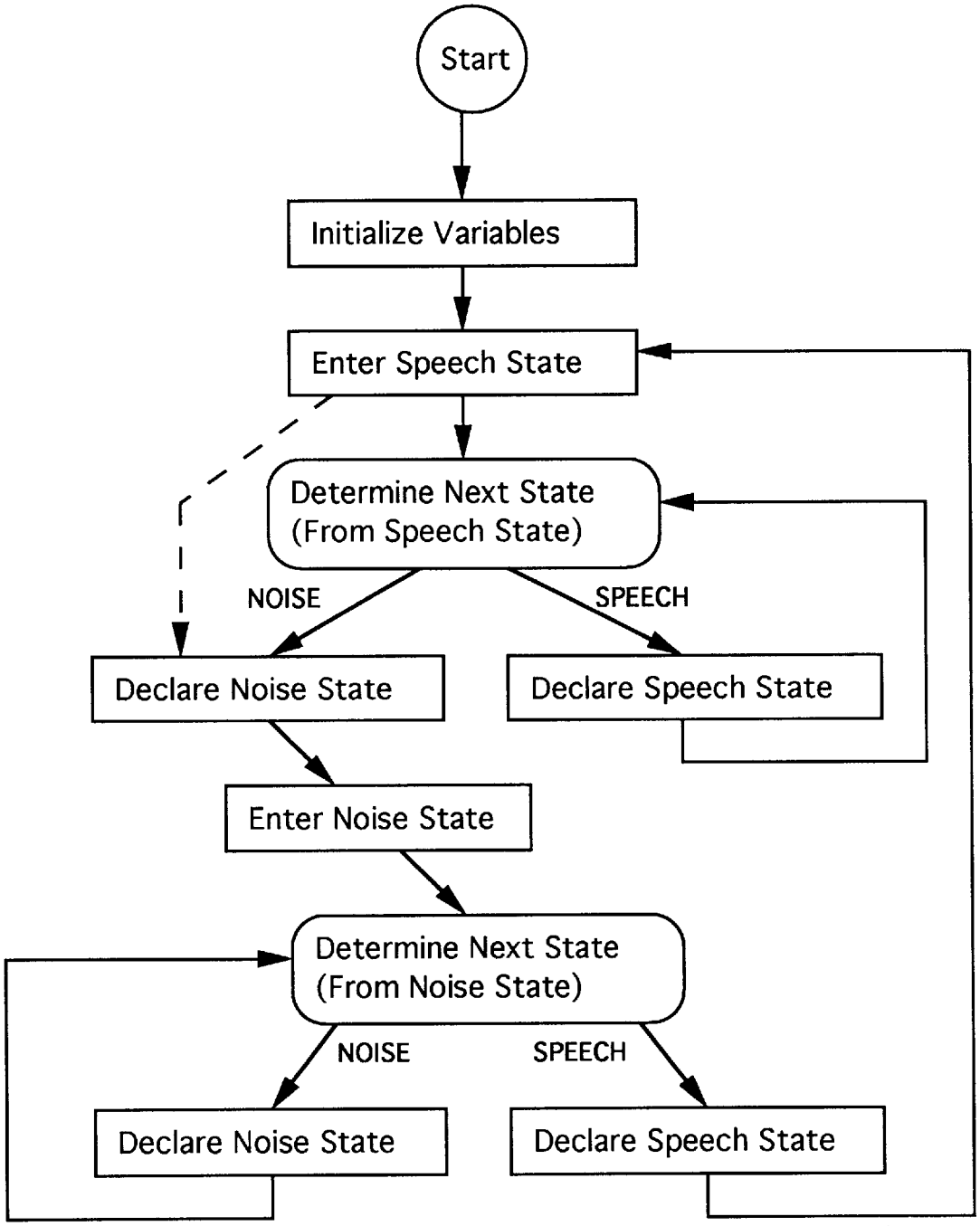
FIG. 3 is a flow chart showing major steps in a method by which the DSP of FIG. 1 is operated.

FIG. 3 is a flow chart showing major steps in a method by which the processor 110 is operated to distinguish speech intervals from noise intervals as speech processing executed by the processor 110 on the digitally encoded audio signal. When the processor 110 is started up, it initializes several variables and enters the speech state.

In the speech state, the processor 110 executes instructions required to determine whether the next frame of the audio signal is a noise interval. If the next frame of the audio signal is determined to be a noise interval, the processor 110 declares the noise state for that frame and enters the noise state. If the next frame of the audio signal is not determined to be a noise interval, the processor 110 declares the speech state for that frame and remains in the speech state.

In the noise state, the processor 110 executes instructions required to determine whether the next frame of the audio signal is a speech interval. If the next frame of the audio signal is determined to be a speech interval, the processor 110 declares the speech state for that frame and enters the speech state. If the next frame of the audio signal is not determined to be a speech interval, the processor 110 declares the noise state for that frame and remains in the noise state.

The steps executed to determine whether the next frame of the audio signal is a speech interval or a noise interval depend upon whether the present state is the speech state or the noise state as will be described in detail below. Moreover, the steps executed upon entering the speech state include steps which enable a fast speech state to noise state transition (shown as a dashed line in FIG. 3) if the previous transition to the speech state is determined to be erroneous, as will be described in greater detail below.

Figure 4:
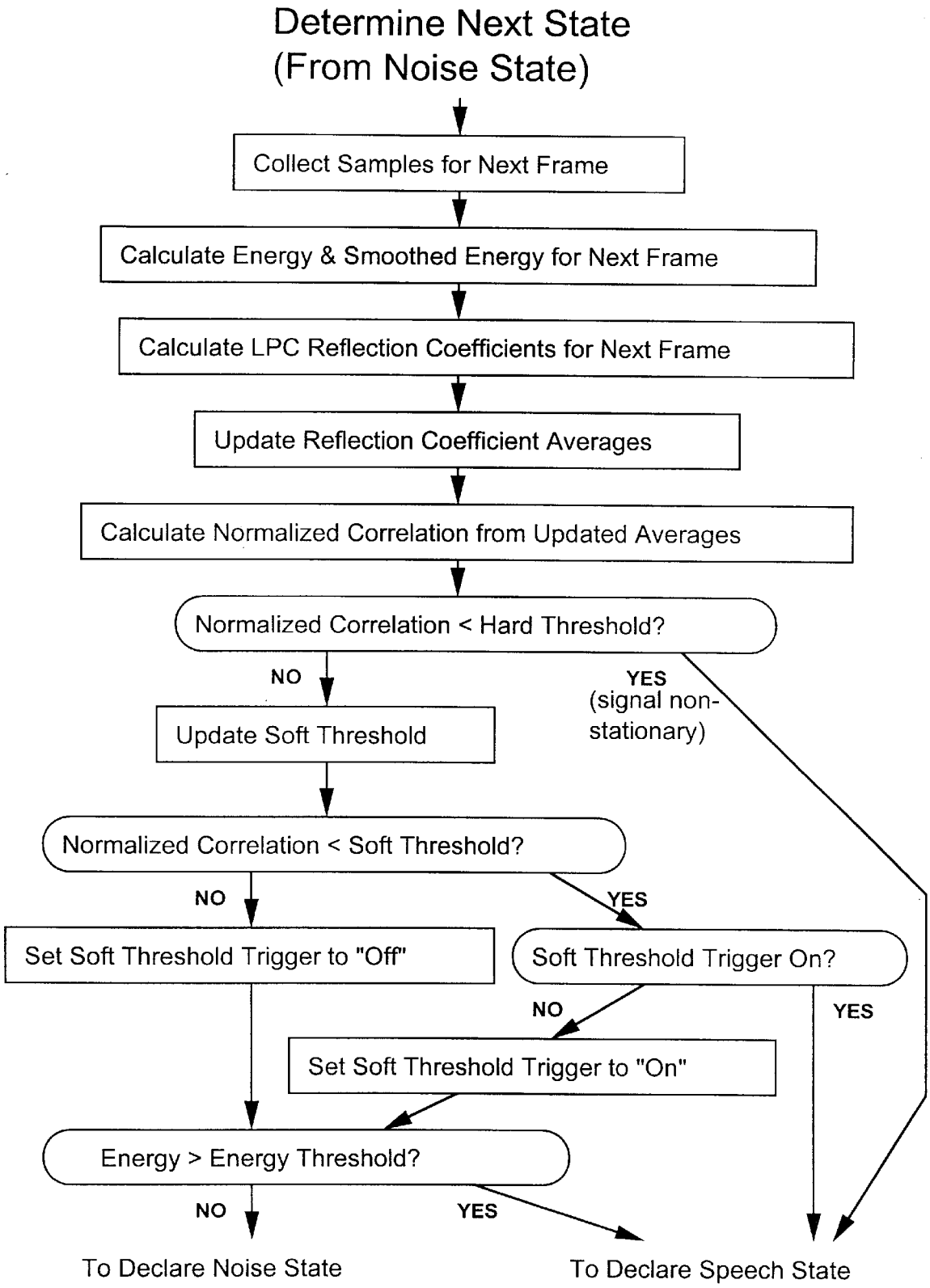
FIG. 4 is a flow chart showing details of a "Determine Next State (From Noise State)" step of the flow chart of FIG. 3.

FIG. 4 is a flow chart showing details of steps executed to determine whether the next frame of the audio signal is a speech interval or a noise interval when the current state is the noise state. These steps are based on the understanding that spectral properties of the audio signal are likely to be relatively stationary during noise intervals and on the understanding that signal intervals having a relatively wide dynamic range of signal energy are likely to be speech intervals.

The 160 samples of the next 20 ms frame are collected, and the energy E(n) of the next frame is calculated. A smoothed energy $E_s(n)$ of the next frame is calculated as a weighted average of the energy E(n) of the next frame and the smoothed energy $E_s(n-1)$ of the previous frame:

$$E_s(n)=d\,E(n)+(1-d)\,E_s(n-1),$$

where d is a weighting factor having a typical value of 0.2.

Ten $10^{th}$ order LPC reflection coefficients are also calculated from the 160 samples using standard LPC analysis techniques as described, for example, in Rabiner et al, "Digital Processing of Speech Signals, Prentice-Hall, 1978" (see page 443 where reflection coefficients are termed PARCOR coefficients). Ten reflection coefficient averages, a(n,1) to a(n,10), are calculated using the reflection coefficients from nineteen immediately preceding frames:

$$a(n,i)=\left(\frac{1}{F}\right)\sum_{j=n-F}^{n-1} r(j,i),$$

where F=19 is the number of preceding frames over which the averages are taken, and r(j,i) are the reflection coefficients calculated for the $j^{th}$ frame. A vector A(n) is formed of the ten reflection coefficient averages, a vector R(n) is formed of the ten reflection coefficients for the next frame, and, as illustrated in FIG. 4, a normalized correlation C(n) is calculated from the vectors:

$$C(n)=\frac{A(n)\cdot R(n)}{|A(n)|\,|R(n)|}$$

The normalized correlation, C(n), provides a measure of change in relative values of the LPC reflection coefficients in the next frame as compared to the relative values of the LPC reflection coefficients averaged over the previous 19 frames.

The normalized correlation has a value approaching unity if there has been little change in the spectral characteristics of the audio signal in the next frame as compared to the average over the previous 19 frames as would be typical of noise intervals. The normalized correlation has a value approaching zero if there has been significant change in the spectral characteristics of the audio signal in the next frame as compared to the average over the previous 19 frames as would be typical for speech intervals. Consequently, the normalized correlation is compared to threshold values, and the next frame is declared to be a speech interval if the normalized correlation is lower than one of the threshold values.

The comparison of the normalized correlation to threshold values is performed in two steps. In a first comparison step shown in FIG. 4, the normalized correlation is compared to a time-invariant "hard threshold", having a typical value of 0.8. If the normalized correlation is lower than the hard threshold, the signal is non-stationary and the next frame is declared to be a speech interval. If the normalized correlation is not lower than the hard threshold, a time-varying "soft threshold" is updated based on recent values of the normalized correlation for frames declared to be noise intervals. If the normalized correlation is lower than the soft threshold for two consecutive frames, the second frame is declared to be a speech interval.

If the normalized correlation is not lower than either the hard threshold or the soft threshold, a final check is made to ensure that the next frame does not have a signal energy which is significantly larger than a "noise floor" calculated on entering the noise state, since wide dynamic ranges of signal energy are typical of speech intervals. The energy E(n) of the next frame is compared to an energy threshold corresponding to the sum of the noise floor and a margin. The next frame is declared to be a speech interval if the energy E(n) of the next frame exceeds the energy threshold. Otherwise, the next frame is declared to be another noise interval.

Thus, in the noise state the processor 110 determines a first parameter set comprising an energy and ten reflection coefficients for each frame. The first parameter set characterizes the energy and spectral properties of a frame of the audio signal. The processor 110 then determines a second parameter set comprising a normalized correlation and a difference between the energy and an energy threshold. The second parameter set indicates the magnitude of changes in the first parameter set over successive frames of the audio signal. The processor 110 declares the next frame to be a speech interval if the second parameter set indicates a change greater than a predetermined change defined by the hard threshold, soft threshold and energy threshold, and declares the next frame to be a noise interval if the second parameter set indicates a change less than the predetermined change.

Figure 5:
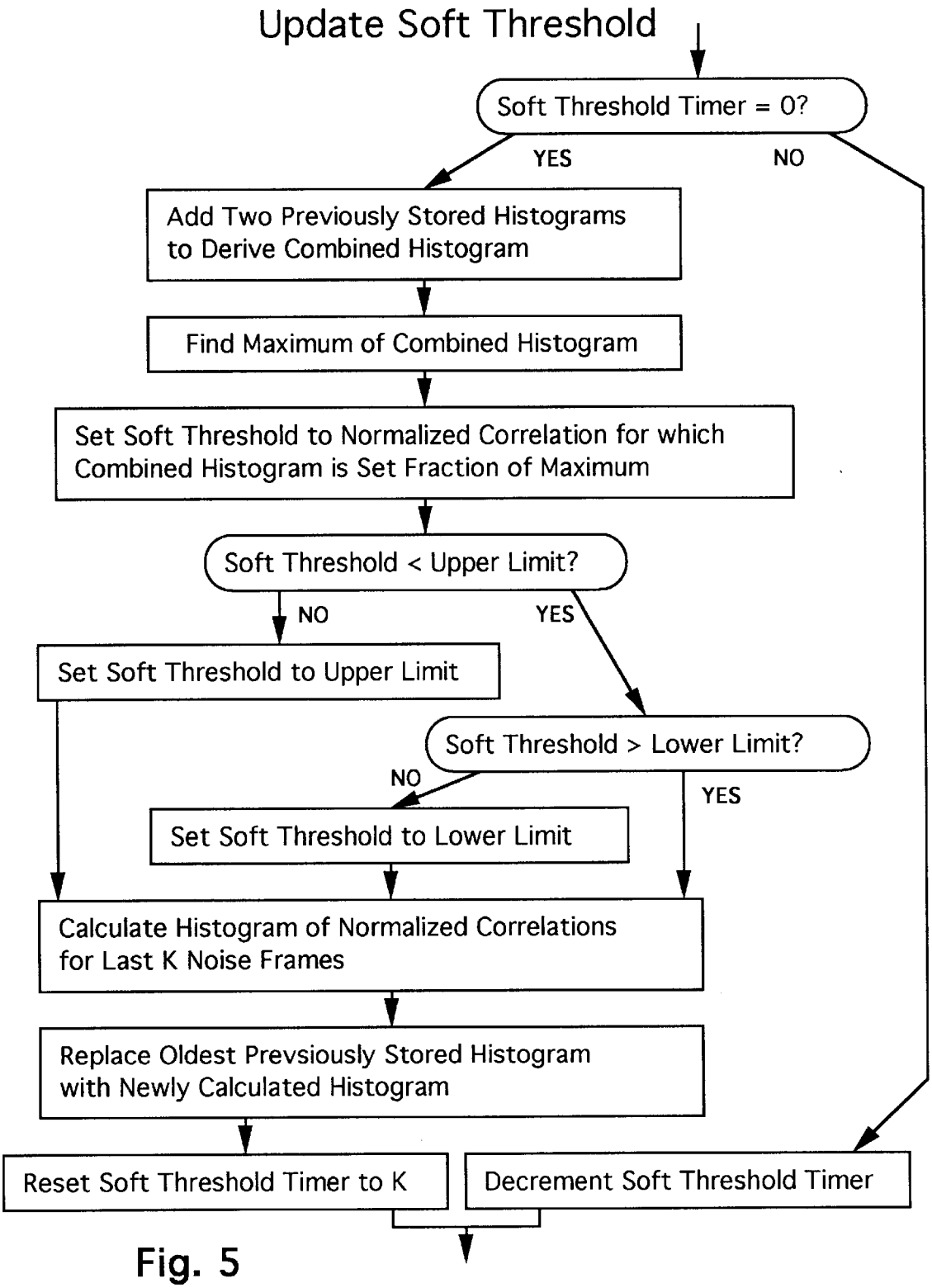
FIG. 5 is a flow chart showing details of an "Update Soft Threshold" step of the flow chart of FIG. 4.

FIG. 5 is a flow chart illustrating steps required to update the soft threshold based on recent values of the normalized correlation for frames declared to be noise intervals. The soft threshold is updated once for every K frames declared to be noise intervals, where K is typically 250. When a soft threshold timer indicates that it is time to update the soft threshold, two previously stored histograms of normalized correlations are added to generate a combined histogram characterizing the 2K recent noise frames. The normalized correlation having the most occurrences in the combined histogram is determined, and the soft threshold is set equal to a normalized correlation which is less than the normalized correlation having the most occurrences in the combined histogram and for which the frequency of occurrences is a set fraction (typically 0.3) of the maximum frequency of occurrences. The soft threshold is reduced to an upper limit (typically 0.95) if it exceeds that upper limit, or increased to a lower limit (typically 0.85) if it is lower than that lower limit. A new histogram of normalized correlations calculated for the last K noise frames is stored in place of the oldest previously stored histogram for use in the next calculation of the soft threshold 250 noise frames later.

Figure 6:
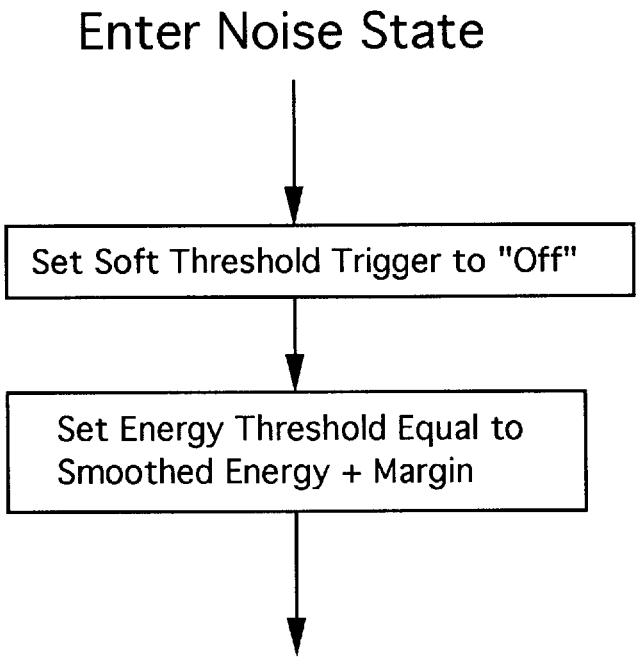
FIG. 6 is a flow chart showing details of an "Enter Noise State" step of the flow chart of FIG. 3.

FIG. 6 is a flow chart illustrating steps which must be performed when the noise state is entered from the speech state to prepare for determination of the next state while in the noise state. The soft threshold trigger is set to "off" to avoid premature declaration of a speech state based on the soft threshold. The energy threshold is updated by adding an energy margin (typically 10 dB) to the smoothed energy $E_s$ of the frame which triggered entry into the noise state.

Figure 7:
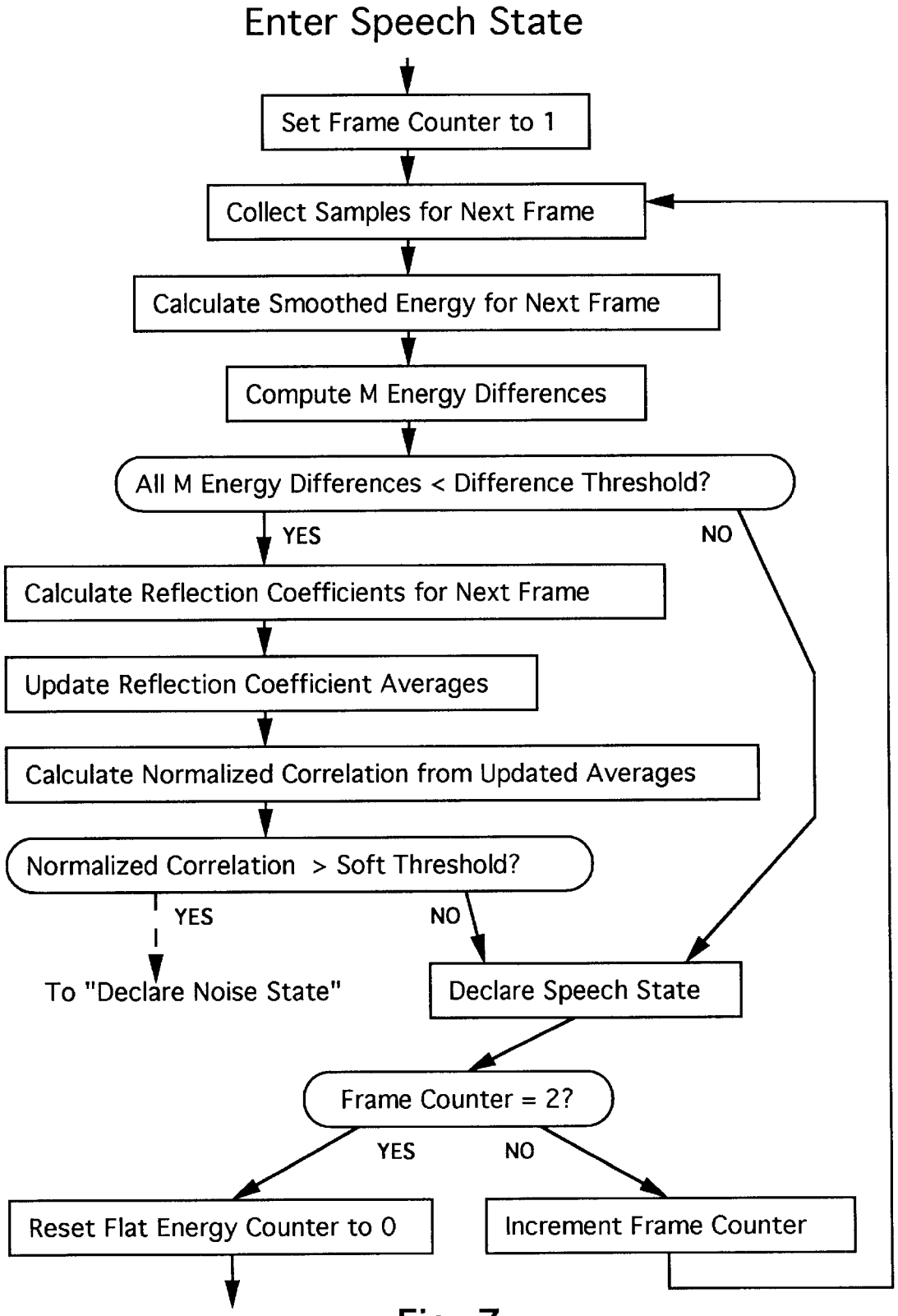
FIG. 7 is a flow chart showing details of an "Enter Speech State" step of the flow chart of FIG. 3.
Figure 8:
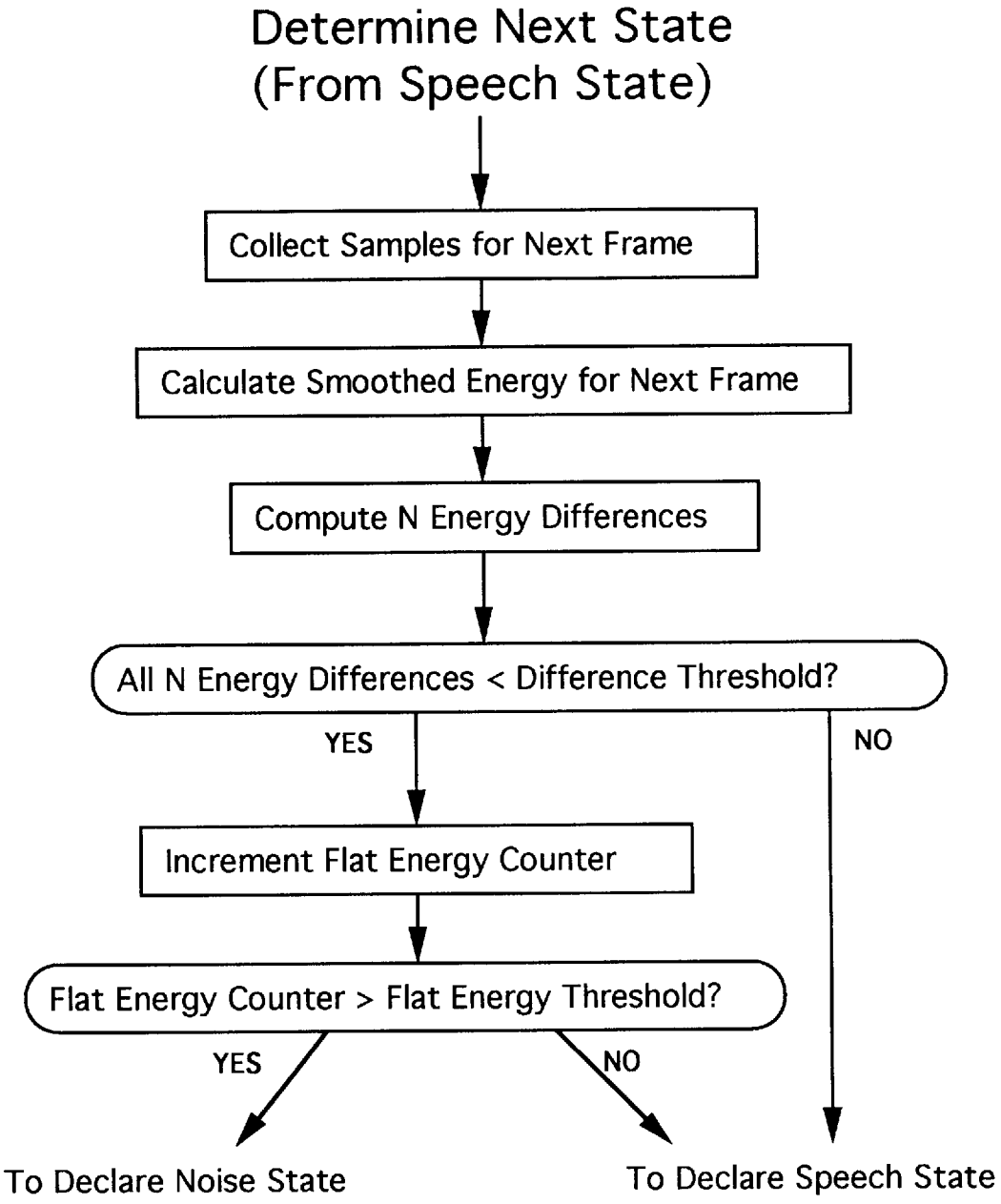
FIG. 8 is a flow chart showing details of a "Determine Next State (From Speech State)" step of the flow chart of FIG. 3.

FIG. 7 is a flow chart illustrating steps performed by the processor 110 upon entering the speech state from the noise state to determine whether a fast transition back to the noise state is warranted. The processor 110 collects samples for a first frame and calculates the smoothed energy for the frame from those samples. M energy difference values, D(i), are computed by subtracting the smoothed energies for each of M previous frames from the smoothed energy calculated for the first frame:

$$D(i)=E_s(n)-E_s(n-i)$$

for i=1 to M, where n is the index of the next frame and M is typically 40. If any of the M energy differences are greater than a difference threshold (typically 2 dB), the immediately preceding noise to speech transition is confirmed and the first frame is declared to be a speech interval. The process is repeated for a second frame and, if the second frame is also declared to be a speech interval, a different process described below with reference to FIG. 8 is used to assess the next frame of the audio signal.

However, if all M energy differences for either the first frame or the second frame are less than the difference threshold, the LPC reflection coefficients are calculated for that frame and the reflection coefficient averages (computed as described above with reference to FIG. 4) are updated. The normalized correlation is calculated using the newly calculated reflection coefficients and the updated reflection coefficient averages, and the normalized correlation is compared to the latest value of the soft threshold. If the normalized correlation exceeds the soft threshold, the frame is declared to be a noise interval and a fast transition is made from the speech state to the noise state.

If the normalized correlation does not exceed the soft threshold or at least one of the M energy differences is not less than the difference threshold, the immediately preceding noise to speech transition is confirmed and the first frame is declared to be a speech interval. The process is repeated for the second frame and, if the second frame is also declared to be a speech interval, a different process described below with reference to FIG. 8 is used to assess the next frame of the audio signal. Before proceeding to the steps illustrated in FIG. 8, the processor 110 resets a flat energy counter to zero so that it is ready for use in the process of FIG. 8.

Thus, immediately after entering the speech state from the noise state, the processor 110 determines a first parameter set comprising a smoothed energy and ten reflection coefficients for the next frame. The first parameter set characterizes the energy and spectral properties of the next frame of the audio signal. The processor 110 then determines a second parameter set comprising M energy differences and a normalized correlation. The second parameter set indicates the magnitude of changes in the first parameter set over successive frames of the audio signal. The processor 110 declares the frame to be a speech interval if the second parameter set indicates a change greater than a predetermined change defined by the difference threshold and the soft threshold, and declares the frame to be a noise interval if the second parameter set indicates a change less than the predetermined change.

FIG. 8 is a flow chart illustrating steps performed to determine the next state when two or more of the immediately preceding frames have been declared to be speech intervals. The processor 110 collects samples for the next frame and calculates the smoothed energy for the next frame from those samples. N energy difference values, D(i), are computed by subtracting the smoothed energies for each of N previous frames from the smoothed energy calculated for the next frame:

$$D(i)=E_s(n)-E_s(n-i)$$

for i=1 to N, where n is the number of the next frame and N is typically 20. If any of the N energy differences are greater than a difference threshold (typically 2 dB), the next frame is declared to be a speech interval. However, if all N energy differences are less than the difference threshold, a flat energy counter is incremented. The next frame is declared to be another speech interval unless the flat energy counter exceeds a flat energy threshold (typically 10), in which case the next frame is declared to be a noise interval.

Thus, in the speech state the processor 110 determines a first parameter set comprising a smoothed energy which characterizes the energy of the next frame of the audio signal. The processor 110 then determines a second parameter set comprising a set of N energy differences and a flat energy counter which indicates the magnitude of changes in the first parameter set over successive frames of the audio signal. The processor 110 declares the next frame to be a speech interval if the second parameter set indicates a change greater than a predetermined change defined by the difference threshold and the flat energy threshold, and declares the next frame to be a noise interval if the second parameter set indicates a change less than the predetermined change.

Figure 9:
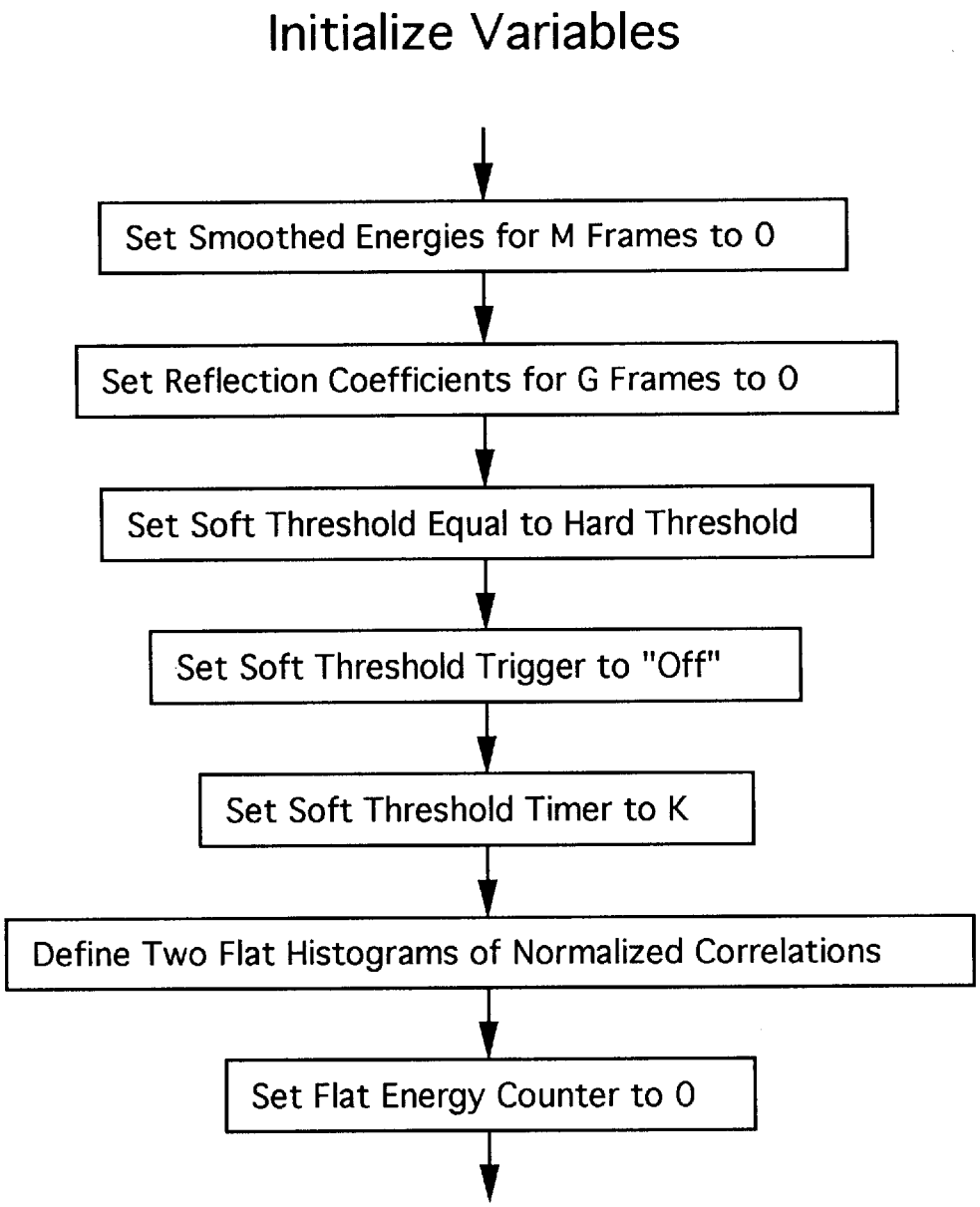
FIG. 9 is a flow chart showing details of an "Initialize Variables" step of the flow chart of FIG. 3.

FIG. 9 is a flow chart showing steps performed when the processor 110 is started up to initialize variables used in the processes illustrated in FIGS. 4 to 8. The variables are initialized to values which favour declaration of speech intervals immediately after the processor 110 is started up since it is generally better to erroneously declare a noise interval to be a speech interval than to declare a speech interval to be a noise interval. While erroneous declaration of noise intervals as speech intervals may lead to unnecessary processing of the audio signal, erroneous declaration of speech intervals as noise intervals leads to loss of information in the coded audio signal.

Similarly, the decision criteria used to distinguish speech intervals from noise intervals are designed to favour declaration of speech intervals in cases of doubt. In the noise state, the process of FIG. 4 reacts rapidly to changes in spectral characteristics or signal energy to trigger a transition to the speech state. In the speech state, the process of FIG. 8 requires stable energy characteristics for many successive frames before triggering a transition to the noise state. Immediately after entering the speech state, the process of FIG. 7 does enable rapid return to the noise state but only if both the energy characteristics and the spectral characteristics are stable for several successive frames.

The embodiment described above may be modified without departing from the principles of the invention, the scope of which is defined by the claims below. For example, the values given above for many of the parameters may be adjusted to suit various applications of the method and apparatus for distinguishing speech intervals from noise intervals.

We claim:

1. A method of distinguishing a stationary signal from a non-stationary signal, the method comprising:

determining a set of Linear Predictive Coding (LPC) coefficients characterizing spectral properties of the signal for each of a plurality of successive time intervals including a current time interval;

averaging the LPC coefficients over a plurality of successive time intervals preceding the current time interval;

determining a cross-correlation of the LPC coefficients for the current time interval with the averaged LPC coefficients;

declaring the signal to be stationary in the current time interval when the cross-correlation exceeds a threshold value; and declaring the signal to be non-stationary in the current time interval when the cross-correlation is less than the threshold value.

2. A method as defined in claim 1, wherein:

the step of determining a set of LPC coefficients for each of a plurality of successive time intervals comprises defining a respective vector of LPC coefficients for each time interval;

the step of averaging the LPC coefficients comprises defining a time averaged vector of LPC coefficients;

the step of determining a cross-correlation comprises calculating an inner product of the vector of LPC coefficients for the current time interval and the time averaged vector of LPC coefficients.

3. A method as defined in claim 2, wherein the step of determining a cross-correlation comprises dividing the inner product by a product of a magnitude of the vector of LPC coefficients for the current time frame and a magnitude of the time averaged vector of LPC coefficients.

4. A method as defined in claim 1, further comprising adjusting the threshold value in response to a distribution of cross-correlations calculated for preceding time intervals.

5. A method as defined in claim 1, wherein the step of determining a set of LPC coefficients comprises determining a set of LPC reflection coefficients.

6. Apparatus for distinguishing a stationary signal from a non-stationary signal, the apparatus comprising a processor and a memory connected to the processor storing instructions for execution by the processor, the instructions comprising:

instructions for determining a set of Linear Predictive Coding (LPC) coefficients characterizing spectral properties of the signal for each of a plurality of successive time intervals including a current time interval;

instructions for averaging the LPC coefficients over a plurality of successive time intervals preceding the current time interval;

instructions for determining a cross-correlation of the LPC coefficients for the current time interval with the averaged LPC coefficients;

instructions for declaring the signal to be stationary in the current time interval when the cross-correlation exceeds a threshold value; and instructions for declaring the signal to be non-stationary in the current time interval when the cross-correlation is less than the threshold value.

7. Apparatus as defined in claim 6, wherein:

the instructions for determining a set of LPC coefficients for each of a plurality of successive time intervals comprise instructions for defining a respective vector of LPC coefficients for each time interval;

the instructions for averaging the LPC coefficients comprise instructions for defining a time averaged vector of LPC coefficients;

the instructions for determining a cross-correlation comprise instructions for calculating an inner product of the vector of LPC coefficients for the current time interval and the time averaged vector of LPC coefficients.

8. Apparatus as defined in claim 7, wherein the instructions for determining a cross-correlation comprise instructions for dividing the inner product by a product of a magnitude of the vector of LPC coefficients for the current time frame and a magnitude of the time averaged vector of LPC coefficients.

9. Apparatus as defined in claim 6, further comprising instructions for adjusting the threshold value in response to a distribution of cross-correlations calculated for preceding time intervals.

10. Apparatus as defined in claim 6, wherein the instructions for determining a set of LPC coefficients comprise instructions for determining a set of LPC reflection coefficients.

11. A processor-readable storage device storing instructions for distinguishing a stationary signal from a non-stationary signal, the instructions comprising:

instructions for determining a set of Linear Predictive Coding (LPC) coefficients characterizing spectral properties of the signal for each of a plurality of successive time intervals including a current time interval;

instructions for averaging the LPC coefficients over a plurality of successive time intervals preceding the current time interval;

instructions for determining a cross-correlation of the LPC coefficients for the current time interval with the averaged LPC coefficients;

instructions for declaring the signal to be stationary in the current time interval when the cross-correlation exceeds a threshold value; and instructions for declaring the signal to be non-stationary in the current time interval when the cross-correlation is less than the threshold value.

12. A device as defined in claim 11, wherein:

the instructions for determining a set of LPC coefficients for each of a plurality of successive time intervals comprise instructions for defining a respective vector of LPC coefficients for each time interval;

the instructions for averaging the LPC coefficients comprise instructions for defining a time averaged vector of LPC coefficients;

the instructions for determining a cross-correlation comprise instructions for calculating an inner product of the vector of LPC coefficients for the current time interval and the time averaged vector of LPC coefficients.

13. A device as defined in claim 12, wherein the instructions for determining a cross-correlation comprise instructions for dividing the inner product by a product of a magnitude of the vector of LPC coefficients for the current time frame and a magnitude of the time averaged vector of LPC coefficients.

14. A device as defined in claim 11, wherein the instructions further comprise instructions for adjusting the threshold value in response to a distribution of cross-correlations calculated for preceding time intervals.

15. A device as defined in claim 11, wherein the instructions for determining a set of LPC coefficients comprise instructions for determining a set of LPC reflection coefficients.

16. A method of detecting transitions between an absence-of-speech state and a presence-of-speech state in an audio signal, the method comprising, in the absence-of-speech state detecting a transition to the presence-of-speech state by:

determining a set of Linear Predictive Coding (LPC) coefficients characterizing spectral properties of the signal for each of a plurality of successive time intervals including a current time interval;

averaging the LPC coefficients over a plurality of successive time intervals preceding the current time interval;

determining a cross-correlation of the LPC coefficients for the current time interval with the averaged LPC coefficients; and declaring a transition to the presence-of-speech state when the cross-correlation is less than a threshold value.

17. A method as defined in claim 16, wherein:

the step of determining a set of LPC coefficients for each of a plurality of successive time intervals comprises defining a respective vector of LPC coefficients for each time interval;

the step of averaging the LPC coefficients comprises defining a time averaged vector of LPC coefficients;

the step of determining a cross-correlation comprises calculating an inner product of the vector of LPC coefficients for the current time interval and the time averaged vector of LPC coefficients.

18. A method as defined in claim 17, wherein the step of determining a cross-correlation comprises dividing the inner product by a product of a magnitude of the vector of LPC coefficients for the current time frame and a magnitude of the time averaged vector of LPC coefficients.

19. A method s defined in claim 16, further comprising adjusting the threshold value in response to a distribution of cross-correlations calculated for preceding time intervals.

20. A method as defined in claim 16, further comprising, in the presence-of-speech state, detecting a transition to the absence-of-speech state by:

determining an energy parameter characterizing the audio signal for each of a plurality of successive time intervals;

determining an energy change parameter set indicative of magnitudes of changes of values of the energy parameter over the plurality of successive time intervals; and declaring a transition to the absence-of-speech state when the energy change parameter set indicates an energy change which is less than a predetermined energy change.

21. A method as defined in claim 20, wherein the step of determining the energy parameter for each of a plurality of successive time intervals comprises, for each particular interval, computing a weighted average of energies calculated for the particular interval and a plurality of intervals preceding the particular interval.

22. A method as defined in claim 21, wherein:

the step of determining an energy change parameter set comprises:

comparing the energy parameter for each particular interval to energy parameters for a plurality of intervals preceding the particular interval to calculate a plurality of energy parameter differences; and incrementing a flat energy counter when all of the calculated energy differences are less than a difference threshold; and the energy change parameter set is deemed to indicate an energy change which is less than a predetermined energy change when the flat energy counter exceeds a flat energy threshold value.

23. A method as defined in claim 16, further comprising computing the energy threshold by adding a margin to a weighted average energy calculated for a time interval in the absence-of-speech state.

* * * * *